US005916650A

United States Patent [19]

Rosenbaum et al.

[11] Patent Number: 5,916,650

[45] Date of Patent: Jun. 29, 1999

[54] REMOVABLE DISPLAY COVER AND METHOD

[76] Inventors: Brian Sidney Rosenbaum, 82 Castleknock Road, Toronto, Ontario, Canada, M5N 2J7; Ronald Howard Rubinoff, 115 Roxborough Lane, Thornhill, Ontario, Canada, L4J 4T5

[21] Appl. No.: 08/844,412

[22] Filed: Apr. 18, 1997

[51] Int. Cl.[6] ..... A47G 1/06

[52] U.S. Cl. ..... 428/40.1; 40/702; 40/737; 40/772; 40/798; 428/41.5; 428/41.6; 428/42.1; 428/42.2; 428/194; 428/13; 428/14

[58] Field of Search ..... 428/40.1, 41.5, 428/41.6, 42.1, 42.2, 194, 14, 13; 40/702, 737, 772, 798

[56] References Cited

U.S. PATENT DOCUMENTS 4,231,833 11/1980 Lieberman ..... 428/14

4,420,520 12/1983 Jones ..... 118/504

4,914,842 4/1990 Lieberman ..... 428/14

5,714,221 2/1998 Sugibuchi ..... 428/41.8

*Primary Examiner*—Nasser Ahmad

[57] ABSTRACT

A resilient monolithic plastic sheet transparent display cover is used to hold a photograph or other item next to a surface, such as the surface of a refrigerator door. The plastic sheet, such as a cling vinyl, is removably adherent to the surface chosen, and may be peeled off and repositioned as desired. The display cover may include one or more de-bossed portions of suitable sizes for receiving photographs or other items, and may be provided with an attractive decorated, non-transparent border, or frame region for enhancing the appearance of the item to be displayed.

19 Claims, 4 Drawing Sheets

REMOVABLE DISPLAY COVER AND METHOD

FIELD OF INVENTION

The present invention relates to the field of display covers generally, and more particularly to the field of removable display covers which may be placed on a surface and subsequently repositioned or removed from that surface. Most specifically it relates to removable display covers for capturing an item to be displayed, such as a photograph, and maintaining it next to a surface, the display covers having a transparent region through which the item may be viewed and a removable adherent footprint region by which the display cover may adhere to the surface.

BACKGROUND OF THE INVENTION

It is common to find kitchen bulletin boards and household appliances, such as refrigerators, adorned with messages, calendars, family photographs and like materials. These items may be held in place by known means such as adhesive tape or magnets. Such methods for displaying photographs, for example, are not always entirely satisfactory.

If adhesive tapes are used, the tape may begin to droop, the adhesive may dry out and the item may fall to the floor. Alternatively, one may not wish to use adhesive tape in situations in which the tape may stick too well, and, when one wishes to remove the tape it may remove or mar the surface finish of the substrate upon which it has been placed, or may leave a gummy glue residue. Further, adhesive tapes do not generally protect photographs from fading due to prolonged exposure to sunlight.

Refrigerator magnets may also be less than entirely satisfactory. They may not hold sufficiently well depending on the size of the object to be held. They may slip down a surface, rather than hold in position. They may not hold well on a rough or pebbled surface. They do not hold at all on non-ferromagnetic substrata, a problem more evident in recently made refrigerators which have plastic or fibreglass door panels.

Some of these problems may be overcome by fastening a mechanically held display frame to a given wall or domestic appliance surface. However, one may not wish to install a permanent fitting, or one which requires the use of nails or screws which permanently penetrate the surface of the wall or object. Further, one may wish to use a fitting that does not require the use of tools, and that may be removed and adjusted without the need for a new nail or screw hole. Finally, one may wish to remove the fitting completely after a period of time. A permanent fitting, or frame may not have sufficient flexibility to adapt to the contour of a non-flat surface.

There has been, therefore, a long felt need for an improved removable display cover.

DISCLOSURE OF INVENTION

The present invention relates to the use of an at least partially transparent removable adherent sheet or film to hold an item, such as a photograph, against a chosen surface. In a first aspect of the invention there is a removable display cover for holding an item to be displayed adjacent to a surface, that display cover comprising a transparent region through which, in use, the item may be viewed; a footprint region extending from the transparent region, that footprint region having a removable adhesive face for contacting the surface; the covering having means for maintaining the position of the object relative to the transparent region.

In a second aspect of the invention there is a removable display cover for placement on a surface to display at least one item captured between the display cover and the surface, the display cover being formed from a sheet of plastic, that display cover comprising at least one rebate for receiving an item to be displayed, the rebate having a wall formed from the sheet of plastic, through which wall, in use, at least a portion of the item may be viewed; and the sheet has one side for facing the surface, that one side having a removably adhesive footprint for adhering to the surface.

In a third aspect of the invention there is a method for making a removable display cover for holding an item to be displayed adjacent to a surface, that method comprising (a) commencing with a transparent sheet of cling vinyl stock having two faces; b) mating a backing sheet to one face of the stock; (c) printing an opaque layer on the other face; (d) printing a design on the opaque layer; (e) forming at least one rebate in the display cover suitable for receiving, in use, an item to be viewed through the transparent sheet, and the step of forming the rebate includes forming at least a portion of the rebate within a transparent region of the sheet bounded by the border and (f) cutting the stock to finished size.

DETAILED DESCRIPTION OF THE INVENTION

Figure 1:
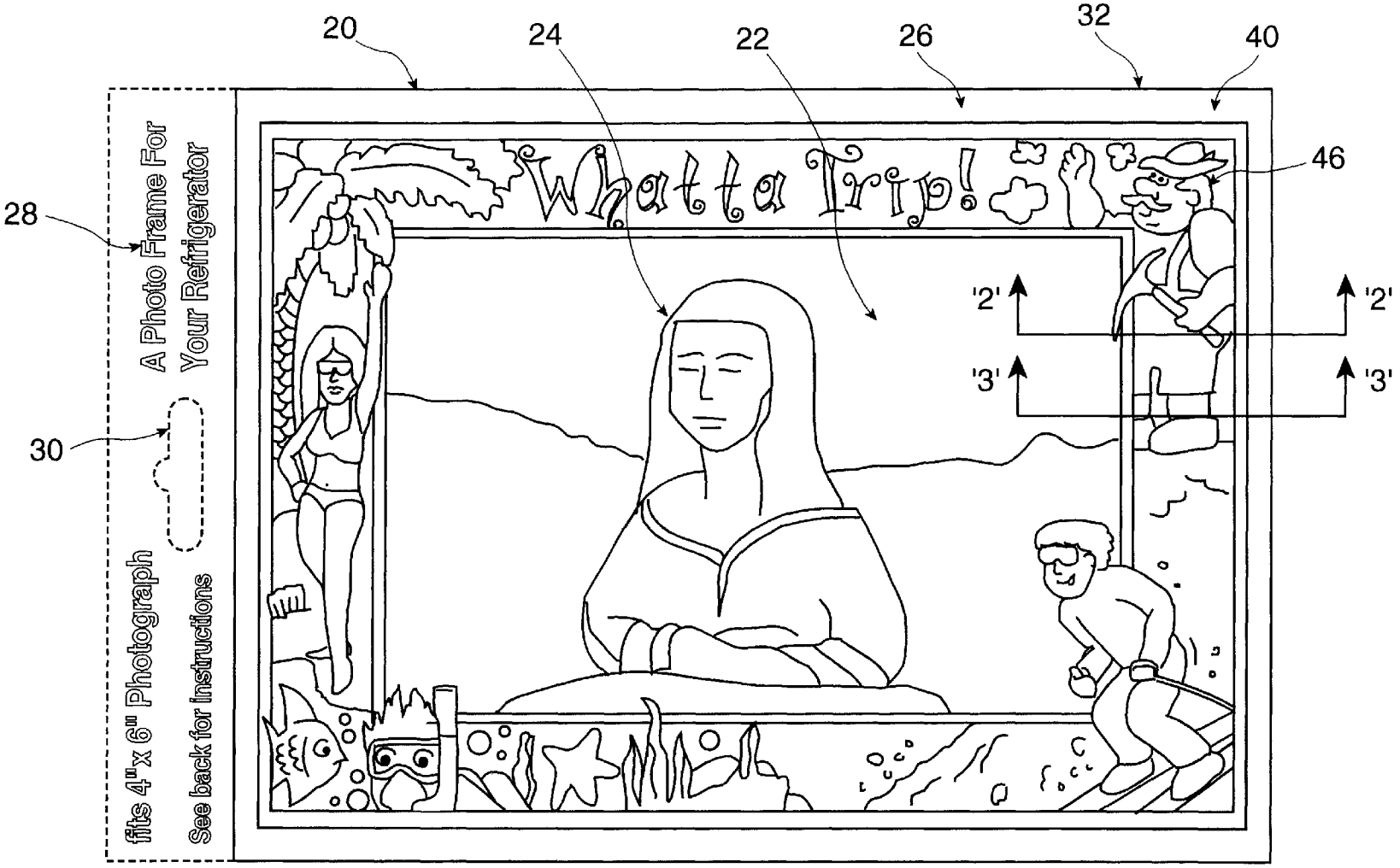
FIG. 1 shows a front view of a first embodiment of a display cover according to the present invention.

In the description which follows, like parts are marked throughout the specification and the drawings with the same respective reference numerals. The drawings are not necessarily to scale and in some instances proportions may have been exaggerated in order more clearly to depict certain features of the invention.

A first embodiment of a removable, flexible, one-piece display cover is shown generally in FIG. 1 as 20. It has a central, transparent region 22, through which, in use, at least part of an object, such as a photograph 24, may be viewed; and a surrounding frame region 26 which forms a border around transparent region 22 and which may be fully or partially opaque or printed. Shown in dashed lines is a header region 28, not forming part of display cover 20, which adjoins frame region 24 at the time of sale in a store, and is separable therefrom for use. Header region 28 and has a die cut aperture 30 to permit the entire assembly hang from a hook.

Figure 2:
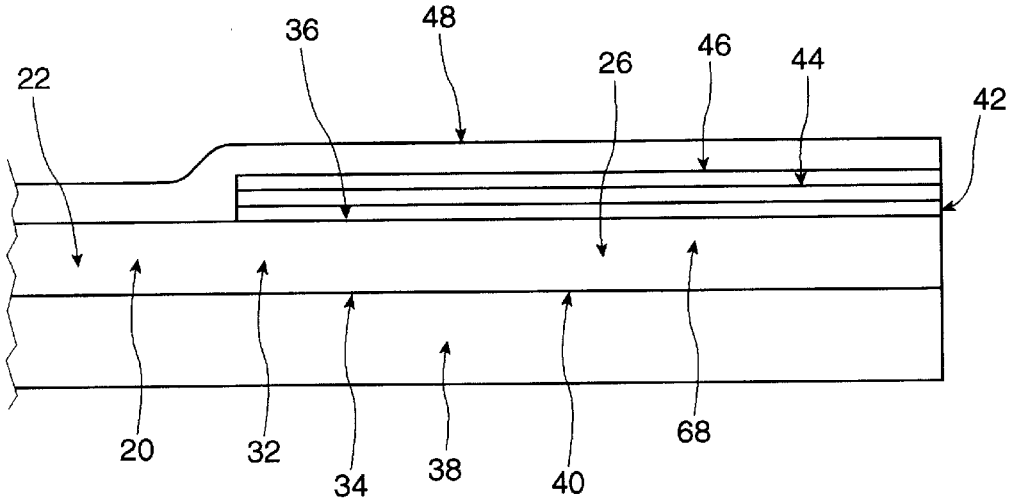
FIG. 2 shows a partial cross section of the display cover of FIG. 1 on the section indicated as '2—2" in FIG. 1 as mounted to a backing sheet for sale.

Referring now to FIG. 2, the removable display cover 20 is shown in partial section, much enlarged, and with several features exaggerated in thickness for the purposes of identification and illustration. As shown in FIG. 2, display cover 20 includes a monolithic cling vinyl plastic sheet 32 having two sides, one side 34, in use, for facing a wall or other surface, and the other side 36 for facing away from that wall or surface. For sale, display cover 20 carries, on its downward, or back side, side 32, a removable backing sheet 38, which may be suitably coated cardstock, and from which backing sheet 38 display cover 20 is to be peeled to expose a removable adhesive footprint 40 of side 34 for application to a chosen surface.

On the upper or front side of display cover 20, being side 36, shown with greatly exaggerated thickness, are a number of coating or printing layers. The first of these are two opaque white layers 42 and 44 screen printed onto frame region 26. Superimposed upon layer 44 is a four colour lithographic process print layer 46 which gives colour to frame region 26, and which may have fanciful or comic illustrations and captions. An ultra-violet coating 48 is applied across the entire extent of side 36 and any accumulated coatings of display cover 20, and thereby provides resistance to fading for both print layer 46 of frame region 26 and for whatever object may underlie transparent region 22.

Figure 3:
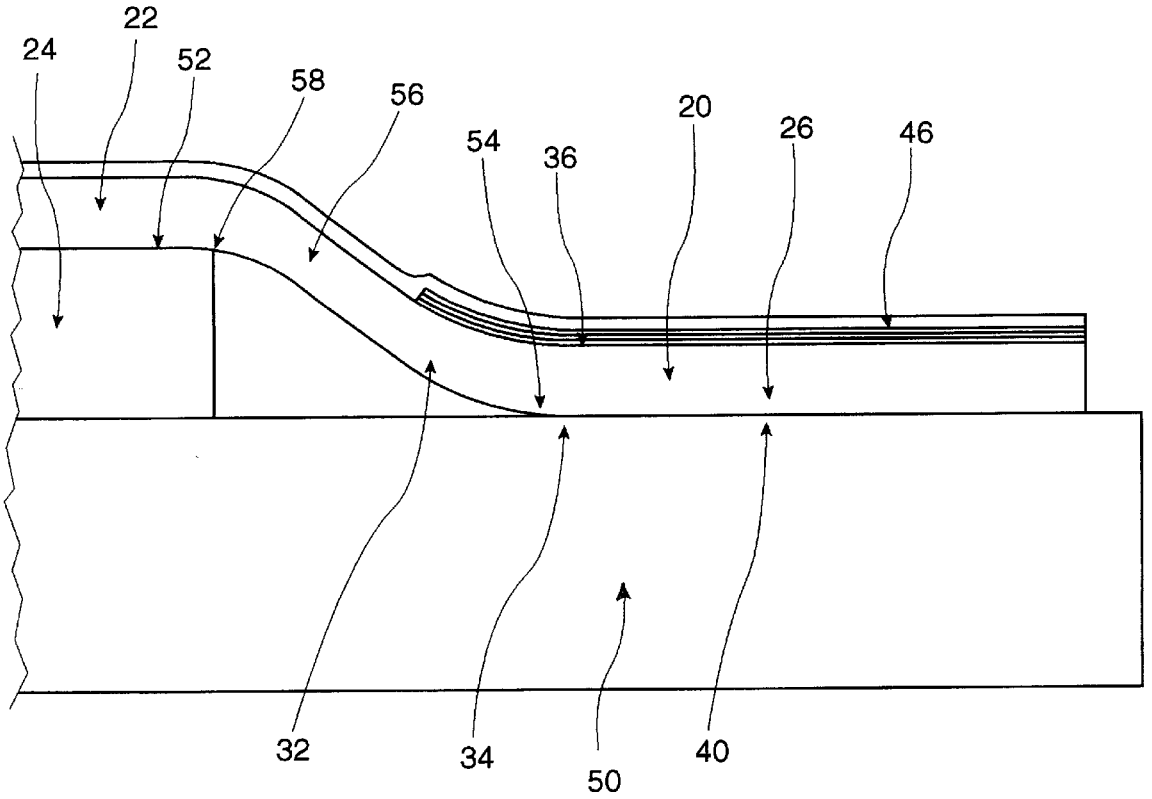
FIG. 3 shows a partial cross section of the display cover of FIG. 1 on the section indicated as '3—3" in FIG. 1 as installed on a surface.

A similar cross section to that of FIG. 2 is shown in FIG. 3, in which backing sheet 38 has been peeled away from display cover 20, and display cover 20 has been applied to an adherend 50, which may be a wall, a flat surface, or the contoured surface of a refrigerator or other suitable household appliance. As shown in FIG. 3 a viewable object such as a photograph 24, is captured between display cover 20 and adherend 50. In the embodiment illustrated that portion of side 34 which forms an inner face 52 of transparent region 22 has the same clinging properties as any other portion of the cling vinyl stock from which display cover 20 is formed, and hence tends to adhere to such objects as it may contact, such as, for example, photograph 24. This need not be so. It may be advantageous to mask or coat all, or a portion of, inner face 52 with a non-stick transparent coating, whether of a nylon (T.M.) based nature or of a silicone based nature, or to provide an optional transparent prophylactic blank having a non-stick face for contacting photograph 24. Whether or not photograph 24 adheres to inner face 52, it will be maintained by the adhesion of footprint 40 in position relative to adherend 50.

Being removably adherent, display cover 20 can be peeled off adherend 50, and repositioned as desired. As shown in FIG. 3, display cover 20 is lifted away from adherend 50 at a separation point designated as 54, and bridges a gap region 56 before contacting an edge 58 of object 24. Gap region 56 may give rise to bubbles or entrapped air pockets, that is regions in which inner face 52 does not lie in contact with photograph 24. It is desirable to avoid or reduce these air pockets since they are both unsightly and tend to increase in size over time, causing portions of display cover 20 to separate from adherend 50.

Figure 4:
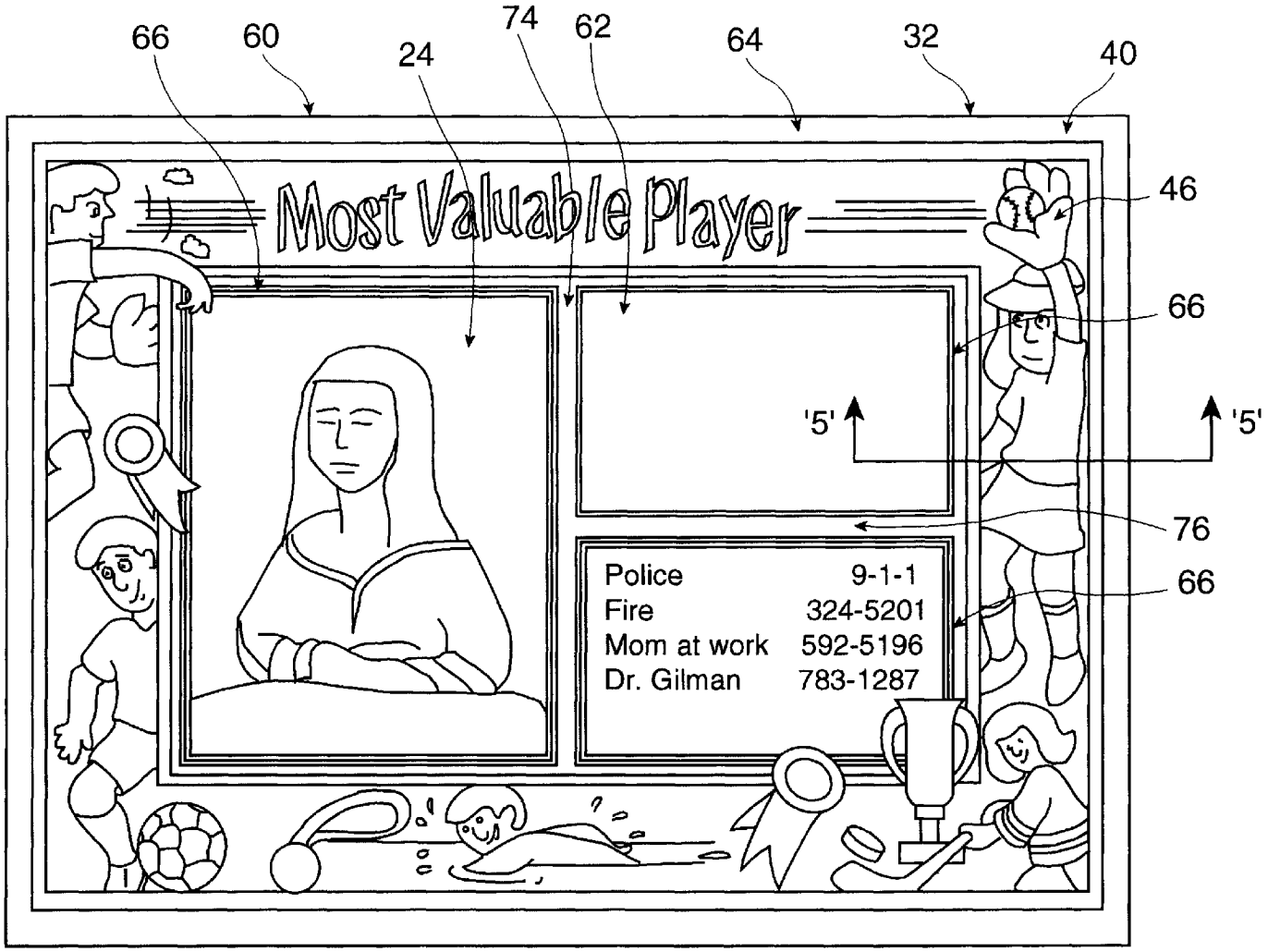
FIG. 4 shows a front view of a second embodiment of a display cover according to the present invention.
Figure 5:
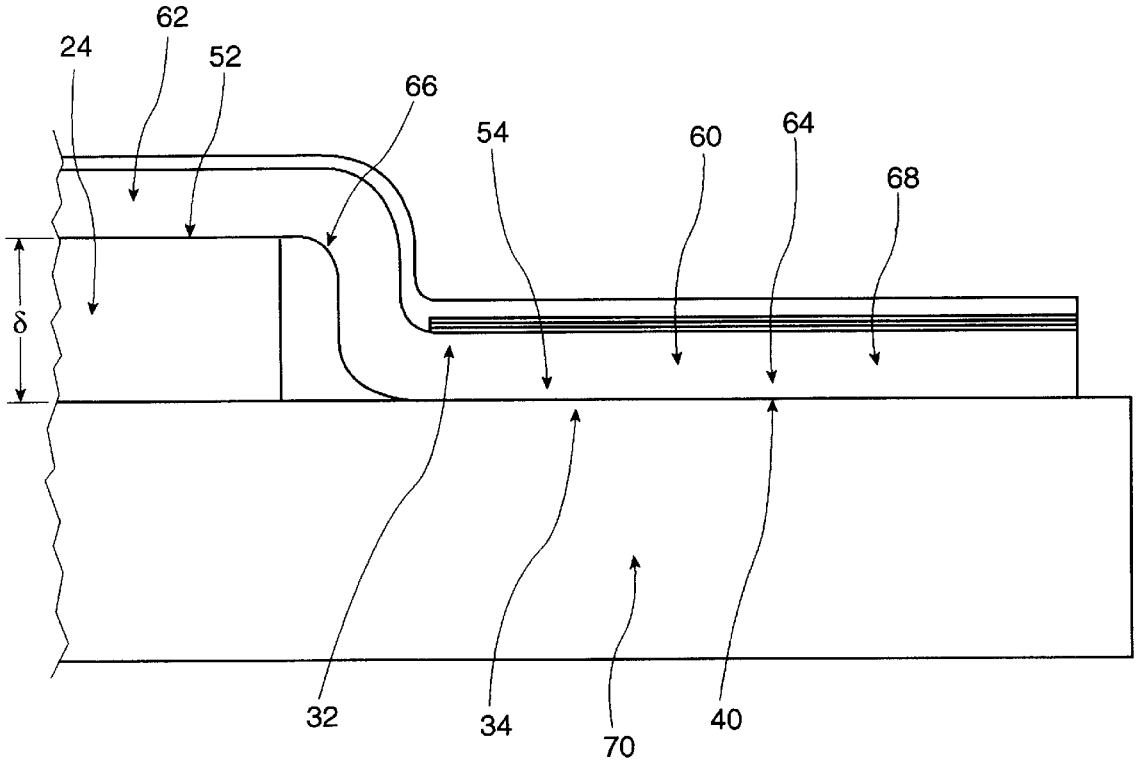
FIG. 5 shows a cross section of the display cover of FIG. 4 taken on the section indicated as '5—5' in FIG. 4 as installed on a surface.

A second, preferred embodiment of the present invention is illustrated in FIGS. 4 and 5. FIG. 4 shows a display cover 60 having a transparent central region 62 and a frame region 64 thereabout. Frame region 64 is provided with similar coatings, colour printing, and U-V layers, and is underlain by a footprint as described above. As is shown in FIG. 5, central region 62 has been formed in display cover 60 with a rebate 66 having a rebate depth δ. Rebate 66 has been formed in a de-bossing, or stamping process which permanently deforms a web stock 68 from which display cover 60 is made. In the preferred embodiment depth dimension δ corresponds to a standard thickness of commonly available photographic paper, typically in the range of 0.004 to 0.020 inches, but may be greater or less than this dimension as may be found suitable. Similarly each rebate 66 is preferably chosen to have a width and length somewhat greater than standard photograph sizes so that each rebate 66 may comfortably accommodate a standard sized photograph. The inventors have found that, as compared to the un-deformed sheet of display cover 20, creation of rebate 66 significantly improves the ability of display cover 60 to adhere to a number of surfaces, first by reducing the tendency to lift away from an adherend 70 in the region of separation point 72, and second by discouraging the formation of large gaps or air pockets adjacent a captured object, such as photograph 24. A single rebate may be provided, or a plurality of rebates may be provided, separated by one or more mullion members 74 or transom members 76 or both, as may be desired. In particular, use of one or more rebates like rebate 66 has improved adhesion to some moderately roughened, pebbled and non-flat surfaces.

Two principle types of removable surface display cover sheet materials have been used by the present inventors. First, the inventors have used static cling vinyl materials in sheet form. In the most preferred embodiment the sheet is 7.5 mil thick plasticized, top coated clear flexible vinyl, and is designated commercially as PRO-STAT (T.M.) Static Cling Vinyl available from Protac Inc., of Blaine Minn. Second are flexible, calendared vinyl sheets having a removably adhesive surface layer or surface treatment. The inventors have used a product designated commercially as Ultra-Repositional (T.M.) 4.0 mil thick sheet, also supplied by Protac Inc., of Blaine Minn. and having a solvent and UV resistant acrylic adhesive surface formulation prepared by Protac Inc. The latter type of sheet, as supplied by Protac, has been found relatively strongly adherent even on pebbled, or roughened surfaces, such as drywall, filing cabinets, and plastic refrigerator door panels and the like.

The methods of production of display cover 20 and display cover 60 will now be described. In each instance one commences with a standard sheet of web stock 68 of whichever material has been chosen. A standard sheet may be 25 inches by 36 inches, which can yield, for example, 16 finished display covers of 8 inch by 6 in dimensions for containing a photograph, or combination of photographs of 6 inches by 4 inches.

In the next step a suitable release liner, backing sheet 38, is mated to one side of web stock 68. Protac suggests a 10 pt. White Board backing for 7.5 mil cling vinyl, and a 90# White Kraft paper for 4.0 mil calendared vinyl. Two hits of opaque white are screen printed onto the other side of web stock 68 to form opaque layers 42 and 44, followed by a four colour lithographic process which imposes print layer 46 on top of opaque layer 44. It is possible to print directly on web stock 68, but it is preferred to use at least one opaque layer to discourage "washout" of the colours in bright light. A final layer of UV coating 48 is then applied to the entire outward surface of the cling vinyl product to prevent fading. A set of instructions is printed on backing sheet 38. These instructions may be printed before or after other steps in the operation as may be convenient.

In the case of the second embodiment described above, the de-bossing, or stamping, process follows the printing and coating processes as a matter of convenience, though it would appear that this order of steps is not necessarily required.

Whether the first or second embodiment described is being manufactured, the web stock 68 is then kiss-cut through the plastic sheet, but not through backing sheet 38 to provide separation line between the various header regions 28 and the display covers 20 (or 60, as the case may be). The final production step is to die cut web stock 68 to create hanging apertures 30 and to separate adjacent display covers 20 from each other.

In use, display cover 20 is peeled away from backing sheet 38, held in a position for placing at least one portion of footprint 40 in contact with a suitable surface, in a chosen position relative to the placement of an item, such as photograph 24 relative to that surface, and is then smoothed down against the surface. Alternatively, particularly when the surface of the item will adhere to display cover 20, the item may be positioned against the back side of display cover 20 first, and centred as desired before placing display cover 20 in final position against the surface. To change position display cover 20 is peeled up and re-applied as before.

Display cover 60 is used in a similar manner, with the additional step of aligning the item, or items, such as photograph 24, within rebate 66 before smoothing footprint 40 against adherend 70.

Although in the embodiments illustrated it is convenient, and preferred that adhesive footprint 40 of side 34 be more or less co-extensive with the border formed by frame region 26, (or 64 as the case may be), and that frame region 26 fully surround transparent region 22, (or region 62 in the second embodiment), and that transparent region 22 be roughly equal in extent to the surface of photograph 24, none of these conditions need necessarily be so. For example, frame region 26 may overlie a portion of photograph 24, or none of it, provided that at least a portion of photograph 24 can be seen through transparent region 22. Footprint 40, that is to say the part of side 34 which actually adheres to the chosen surface, could be masked or limited to a small portion of frame region 26 provided that the remaining area is, or discretely separated areas are, sufficient to hold an object in place. Similarly, frame region 26 need only extend about a portion of transparent region 22, whether a single side, if the object adheres to transparent region 22 and hangs therefrom, or two opposite side, or three sides in the form of a horse-shoe or crescent to form a side or top opening pocket. Further, although a rectangular frame is shown other shapes, whether square, rhomboidal, round, oval, elliptical or other desired form may be chosen without departing from the principles of the present invention.

In another embodiment, the removable display cover can be used as a post card. That is, the face of backing sheet 38 may carry not only printed instructions for use, but also printed spaces for writing, address and postage in the manner of post cards generally. A user may create a personalized postcard by capturing a photograph or other item between backing sheet 38 and display cover 20, or, preferably display cover 60, to yield a three part, sealed sandwich suitable for mailing. The recipient of this personalized post card may then peel off backing sheet 38 and apply display cover 60 (as the case may be) to a suitable surface. Such a postal package is more likely to resist accidental opening if a more highly adhesive material, such as the Ultra-Repositional (T.M.) material noted above, is employed.

Various embodiments of the invention have now been described in detail. Since changes in and or additions to the above-described embodiments may be made without departing from the nature, spirit or scope of the invention, the invention is not to be limited to those details, but only by the appended claims and their equivalents.

We claim:

1. A removable display cover for holding an item to be displayed between itself and an adjacent surface, said display cover comprising:

a static cling sheet having one side for facing the surface and another side for facing away from the surface, said sheet having a transparent region through which, in use, the item may be viewed;

said one side having a footprint region extending about at least a portion of said transparent region, said footprint region having a static cling face for removably adhering to said surface;

said footprint region being free of adhesive; and said cover being locatable against the adjacent surface to maintain the position of said item relative to said transparent region.

2. The display cover of claim 1 wherein said footprint region and said transparent region are both portions of a monolithic sheet.

3. The display cover of claim 2 wherein said sheet is a flexible plastic sheet.

4. The display cover of claim 1 wherein said footprint region is formed from a cling vinyl plastic sheet.

5. The display cover of claim 1 wherein said cover further includes a border adjacent said transparent region.

6. The display cover of claim 5 wherein said border is substantially opaque.

7. The display cover of claim 6 wherein said border includes a printed pattern.

8. The display cover of claim 1 in the form of a post card package.

9. The display cover of claim 1 wherein said display cover further includes:

a border region extending about said transparent region, said border region including said footprint region, and said border region having a printed pattern visible from said second side.

10. The display cover of claim 1 further including a rebate for accommodating said item.

11. The display cover of claim 10 including a plurality of rebates for accommodating a plurality of items for viewing through said transparent region.

12. The display cover of claim 11 wherein said rebate has a depth corresponding to a thickness of a standard grade of photographic paper.

13. A removable display cover for placement on a surface to display at least one item captured between said display cover and said surface, said display cover formed from a sheet of plastic, said display cover comprising:

at least one rebate for receiving an item to be displayed, said rebate having a wall formed from said sheet of plastic through at least a portion of which, in use, at least a portion of said item may be viewed; and said sheet has one side for facing said surface, said one side having a removable static cling adherent footprint for contacting said surface, said footprint being free of adhesive.

14. The removable display cover of claim 13 wherein:

said sheet has another side for facing away from said surface, and said other side has a substantially opaque border region provided with a printed pattern.

15. The removable display cover of claim 13 wherein said rebate has an inner face for facing said item, and said inner face is provided with a transparent non-stick coating.

16. The removable display cover of claim 13 wherein:

said rebate has an inner face for facing said item; and said display cover is provided with a non-stick layer for placement within said rebate between said inner face and said item.

17. A removable display cover for holding an item to be displayed between itself and an adjacent surface, said cover comprising:

a flexible static cling vinyl sheet having a transparent region through which at least a portion of the item can be viewed;

said sheet having one side for facing away from the surface, and another side for placement next to the surface;

said one side having a printed frame region extending apart at least a portion of said transparent region;

said other side having a static cling vinyl footprint underlying at least a portion of said frame region, said footprint extending at least partially about said central region;

said footprint being free of adhesive; and said cover being removably locatable against the adjacent surface to maintain the position of the item relative to said transparent region.

18. The removable display cover of claim 17 wherein:

said sheet is rectangular;

said frame region extends around the periphery of said transparent region; and said footprint underlies all of said frame region.

19. The removable display cover of claim 17 wherein said footprint can be peeled away from said surface and can be repositioned.

* * * * *